US010373624B2

(12) United States Patent
Choo et al.

(10) Patent No.: US 10,373,624 B2
(45) Date of Patent: Aug. 6, 2019

(54) BROADBAND SIGNAL GENERATING METHOD AND APPARATUS, AND DEVICE EMPLOYING SAME

(71) Applicants: SAMSUNG ELECTRONICS CO., LTD., Suwon-si (KR); INDUSTRY-UNIVERSITY COOPERATION FOUNDATION HANYANG UNIVERSITY ERICA CAMPUS, Ansan-si (KR)

(72) Inventors: Ki-Hyun Choo, Seoul (KR); Sang-won Kang, Ansan-si (KR); Ho-sang Sung, Yongin-si (KR); Eun-mi Oh, Seoul (KR); Jong-geun Jeon, Ansan-si (KR); Yaxing Li, Ansan-si (KR)

(73) Assignees: SAMSUNG ELECTRONICS CO., LTD., Suwon-si (KR); INDUSTRY-UNIVERSITY COOPERATION FOUNDATION HANYANG UNIVERSITY ERICA CAMPUS, Ansan-si (KR)

( * ) Notice: Subject to any disclaimer, the term of this patent is extended or adjusted under 35 U.S.C. 154(b) by 0 days.

(21) Appl. No.: 15/033,834

(22) PCT Filed: Nov. 3, 2014

(86) PCT No.: PCT/KR2014/010456

§ 371 (c)(1),
(2) Date: May 2, 2016

(87) PCT Pub. No.: WO2015/065137

PCT Pub. Date: May 7, 2015

(65) Prior Publication Data

US 2016/0275959 A1 Sep. 22, 2016

(30) Foreign Application Priority Data

Nov. 2, 2013 (KR) ..... 10-2013-0132623

(51) Int. Cl.
*G10L 19/00* (2013.01)
*G10L 19/09* (2013.01)
(Continued)

(52) U.S. Cl.
CPC ..... *G10L 19/087* (2013.01); *G10L 19/09* (2013.01); *G10L 19/167* (2013.01); *G10L 21/038* (2013.01); *G10L 2019/0016* (2013.01)

(58) Field of Classification Search
None
See application file for complete search history.

(56) References Cited

U.S. PATENT DOCUMENTS 5,978,759 A 11/1999 Tsushima et al.
7,263,481 B2 8/2007 Jabri et al.
(Continued)

FOREIGN PATENT DOCUMENTS

KR 10-2006-0085118 A 7/2006
KR 10-2007-0118167 A 12/2007
(Continued)

OTHER PUBLICATIONS

Fuemmeler, et al.; "Techniques for the Regeneration of Wideband Speech from Narrowband Speech", EURASIP Journal on Applied Signal Processing, 2001, 9 pages total.
(Continued)

*Primary Examiner* — Kevin Ky
(74) *Attorney, Agent, or Firm* — Sughrue Mion, PLLC

(57) ABSTRACT

A method of generating a wideband signal may include estimating a high-band spectrum parameter from a reconstructed narrowband signal based on a combination of at least two mapping schemes; estimating a high-band excitation signal based on the reconstructed narrowband signal; generating a high-band signal based on the estimated high-band spectrum parameter and the estimated high-band exci-
(Continued)

tation signal; and generating a wideband signal by synthesizing the reconstructed narrowband signal with the high-band signal.

16 Claims, 13 Drawing Sheets

(51) Int. Cl.
*G10L 19/16* (2013.01)
*G10L 19/087* (2013.01)
*G10L 21/038* (2013.01)

(56) References Cited

U.S. PATENT DOCUMENTS 7,346,499 B2 * 3/2008 Chennoukh ..... G10L 21/0364 704/205
8,069,040 B2 11/2011 Vos
8,271,267 B2 9/2012 Sung et al.
2003/0093278 A1 * 5/2003 Malah ..... G10L 21/038 704/265
2003/0093279 A1 * 5/2003 Malah ..... G10L 21/038 704/265
2003/0123575 A1 * 7/2003 Nordman ..... H04L 27/2017 375/340
2007/0016417 A1 * 1/2007 Sung ..... G10L 19/035 704/230
2008/0027718 A1 * 1/2008 Krishnan ..... G10L 21/038 704/211
2008/0059166 A1 * 3/2008 Ehara ..... G10L 19/07 704/230
2008/0177532 A1 * 7/2008 Greiss ..... G10L 21/038 704/200.1
2008/0249767 A1 * 10/2008 Ertan ..... G10L 19/005 704/219
2008/0302873 A1 * 12/2008 Kotlarsky ..... G06F 9/44526 235/462.15
2009/0326931 A1 * 12/2009 Ragot ..... G10L 19/24 704/220
2014/0184765 A1 * 7/2014 King ..... H04N 7/18 348/65

FOREIGN PATENT DOCUMENTS

KR 10-0837451 B1 6/2008
KR 10-1171098 B1 8/2012

OTHER PUBLICATIONS

Kornagel, "Techniques for Artificial Bandwidth Extension of Telephone Speech", Signal Processing, 2006, vol. 86, 11 pages total.
Iser, et al.; "Broadband Spectral Envelope Estimation", Bandwidth extension of speech Signals, Springer Science+Business Media, LLC, 233, Spring Street, 2008, 29 pages total.
Linde, et al.; "An Algorithm for Vector Quantizer Design", IEEE Transactions on Communications, Jan. 1980, vol. COM-28, No. 1, 12 pages total.
Ding, et al.; "Over-Attenuated Components Regeneration for Speech Enhancement", IEEE Transactions on Audio, Speech, and Language Processing, Nov. 2010, vol. 18, No. 8, 11 pages total.
"3rd Generation Partnership Project; Technical Specification Group Services and System Aspects; Mandatory Speech CODEC Speech Processing Functions; AMR Speech CODEC; General Description (Release 9)", 3GPP TS 26.071 V9.0.0, Technical Specification, Dec. 2009, 12 pages total.
International Search Report and Written Opinion dated Feb. 25, 2015, issued by the International Searching Authority in counterpart International Application No. PCT/KR2014/010456 (PCT/ISA/210, PCT/ISA/237).

* cited by examiner

BROADBAND SIGNAL GENERATING METHOD AND APPARATUS, AND DEVICE EMPLOYING SAME

This is a National Stage Entry of International Application No. PCT/KR2014/010456 filed Nov. 3, 2014, which claims priority from of Korean Patent Application No. 10-2013-0132623, filed on Nov. 2, 2013, in the Korean Intellectual Property Office, the disclosures of which are incorporated herein in their entireties by reference.

TECHNICAL FIELD

One or more exemplary embodiments relate to decoding of a signal, and more particularly, to a method and an apparatus for generating a wideband signal from a narrowband bitstream and a device employing the same.

BACKGROUND ART

In most voice communication systems, the bandwidth is limited to a range from 0.3 kHz to 3.4 kHz. A speech bandwidth includes a voiced sound section and an unvoiced sound section, where sound quality of a reconstructed signal is deteriorated from that of an original signal due to the limited bandwidth. To reduce deterioration in the sound quality, a wideband speech receiving device has been suggested. A wideband speech having a bandwidth from 0.05 kHz to 7 kHz may cover all voice bandwidths including a voiced sound section and an unvoiced sound section and naturalness and clarity of a wideband speech may be superior than those of a narrowband speech. However, since voice communication applications, such as public switched telephone network (PSTN), an internet phone service such as VoIP and VoWiFi, and a voice-related application installed on a mobile device, are still provided based on narrowband speech codecs, significant time and cost are required for changing a current codec to a wideband codec.

Therefore, to obtain a wideband signal from a narrowband signal via a decoder, various bandwidth extension techniques have been suggested. An example of the bandwidth extension techniques may be a technique for allocating an additional bit for a high-band, that is, a guided bandwidth extension. The guided bandwidth extension is a technique for extending a speech bandwidth by using encoding information transmitted from an encoder, where additional information therefor is included in a bitstream. An encoder analyzes a speech signal and generates and transmits the additional information for a high-band signal. A decoder generates a high-band signal based on the transmitted additional information and a low-band signal. Another example of the bandwidth extension techniques may be a technique for generating a high-band signal from a low-band signal in a decoder without allocating an additional bit, e.g., a blind bandwidth extension. To this end, techniques based on estimations using pattern recognizing techniques, such as the hidden Markov model and the Gaussian mixture model, have been suggested. However, pattern recognition requires a training process, and efficiency of the pattern recognition may vary according to languages for recognition. Furthermore, since an amount of calculations for prediction or estimation significantly increases, it is difficult to quickly and effectively process a speech signal received in real time. In addition, the sound quality of a high-band signal generated without allocation of an additional bit is relatively inferior.

Recently, it becomes more and more necessary to provide a wideband signal or an ultra-wideband signal with improved sound quality to a user from a narrowband signal without an excessive increase of complexity and without changing the basic structure of an existing communication system, that is, the basic structure of a telephony system or a decoder used in a receiving end, even if a bandwidth extension technique is applied.

DISCLOSURE

Technical Problems

One or more exemplary embodiments provide a method and an apparatus for generating a wideband signal from a narrowband bitstream based on blind bandwidth extension and a device employing the same.

Technical Solution

According to one or more exemplary embodiments, a method of generating a wideband signal, the method comprising estimating a high-band spectrum parameter from a reconstructed narrowband signal based on a combination of at least two mapping schemes, estimating a high-band excitation signal from the reconstructed narrowband signal, generating a high-band signal based on the estimated high-band spectrum parameter and the estimated high-band excitation signal, and generating a wideband signal by synthesizing the reconstructed narrowband signal with the high-band signal.

According to one or more exemplary embodiments, a method of generating a wideband signal, the method comprises estimating a high-band spectrum parameter from a reconstructed narrowband signal, whitening the reconstructed narrowband signal and estimating a high-band excitation signal based on the whitened narrowband signal, generating a high-band signal based on the estimated high-band spectrum parameter and the estimated high-band excitation signal, and generating a wideband signal by synthesizing the reconstructed narrowband signal with the high-band signal.

According to one or more exemplary embodiments, a wideband signal generating apparatus comprises a high-band signal generator, which estimates a high-band envelope signal from a reconstructed narrowband signal based on a combination of a codebook mapping scheme and a linear mapping scheme, estimates a high-band excitation signal from the reconstructed narrowband signal, and generates a high-band signal, and a synthesizer, which generates a wideband signal by synthesizing the reconstructed narrowband signal with the high-band signal.

According to one or more exemplary embodiments, a wideband signal generating apparatus comprises a high-band signal generator, which estimates a high-band envelope signal based on a reconstructed narrowband signal, estimates a high-band excitation signal based on a signal obtained by whitening the reconstructed narrowband signal, and generates a high-band signal, and a synthesizer, which generates a wideband signal by synthesizing the reconstructed narrowband signal with the high-band signal.

Advantageous Effects

A wideband signal or an ultra-wideband signal with improved sound quality may be provided to a user from a narrowband signal without an excessive increase of complexity and without changing the basic structure of a communication system supporting the narrowband, that is, the basic structure of a telephony system or a decoder used in a receiving end. Furthermore, since it is not necessary to include an additional bit for bandwidth extension into a bitstream provided by an encoder, one or more exemplary embodiments may be more suitable for a low-bitrate network. Furthermore, since bandwidth extension is selectively performed based on a user input or characteristics of a narrowband signal, a narrowband signal or a wideband signal may be selectively provided.

MODE FOR INVENTION

The present invention will now be described more fully with reference to the accompanying drawings, in which exemplary embodiments of the invention are shown. In the description of the present invention, if it is determined that a detailed description of commonly-used technologies or structures related to the invention may unnecessarily obscure the subject matter of the invention, the detailed description will be omitted.

Throughout the specification, it will be understood that when a portion is referred to as being "connected to" another portion, it can be "directly connected to" the other portion or "electrically connected to" the other portion via another element.

While such terms as "first," "second," etc., may be used to describe various components, such components must not be limited to the above terms. The above terms are used only to distinguish one component from another.

The term 'signal' includes parameters, coefficients, and elements and may be interpreted otherwise or may be used as a combination of definitions thereof.

In addition, the term "units" described in the specification mean units for processing at least one function and operation and can be implemented by software components or hardware components, such as FPGA or ASIC. However, the "units" are not limited to software components or hardware components. The "units" may be embodied on a recording medium and may be configured to operate one or more processors. Therefore, for example, the "units" may include components, such as software components, object-oriented software components, class components, and task components, processes, functions, properties, procedures, subroutines, program code segments, drivers, firmware, micro codes, circuits, data, databases, data structures, tables, arrays, and variables. Components and functions provided in the "units" may be combined to smaller numbers of components and "units" or may be further divided into larger numbers of components and "units."

Figure 1:
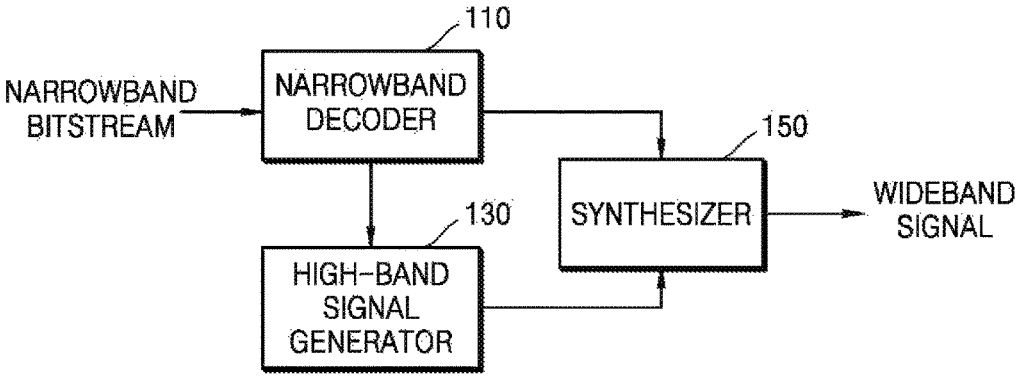
FIG. 1 shows a block diagram of a wideband signal generating apparatus according to an exemplary embodiment.

FIG. 1 is a block diagram showing the configuration of a wideband signal generating apparatus according to an exemplary embodiment.

The wideband signal generating apparatus shown in FIG. 1 may include a narrowband decoder 110, a high-band signal generator 130, and a synthesizer 150. All of the narrowband decoder 110, the high-band signal generator 130, and the synthesizer 150 may be included in a single device. Alternatively, the narrowband decoder 110 may be included in a first device, whereas the high-band signal generator 130 and the synthesizer 150 may be included in a second device. An example of the first device may be a multimedia device, such as a mobile device including a signal decoding module. Examples of the second device may be a headset or an external speaker that may be connected to a multimedia device. Components included in a single device may be integrated into a single module and embodied as a processor. Here, a signal may refer to an audio signal, a speech signal, or a mixture of an audio signal and a speech signal. For convenience of explanation, the signal will refer to a speech signal below. Meanwhile, a narrowband may commonly refer to a frequency range from 0.3 KHz to 3.4 kHz, whereas a high-band may commonly refer to a frequency range from 3.7 KHz to 7 KHz. However, the frequency ranges are not limited thereto and may vary based on tradeoffs between various parameters including network conditions, performance of devices, or desired quality. Meanwhile, a wideband may be a frequency range including the narrowband and the high-band. If necessary, the wideband may be extended to an ultra wideband.

Referring to FIG. 1, the narrowband decoder 110 may generate a reconstructed narrowband signal by decoding a narrowband bitstream. The narrowband bitstream may be provided via a network or provided from a storage medium. The narrowband decoder 110 may be implemented in correspondence to a codec algorithm applied to the narrowband bitstream. For example, the narrowband decoder 110 may apply a standardized algorithm or another codec algorithm and may preferably apply a codec algorithm based on an analysis-by-synthesis structure. A transfer function of an analyzing module and a transfer function of a synthesizing module included in the analysis-by-synthesis structure may have an inverse relationship with each other. The most popular example of codec algorithms based on analysis-by-synthesis structures may be a code-excited linear estimation (CELP). Other examples of codec algorithms based on analysis-by-synthesis structures may include an algebraic CELP (ACELP), a relaxed CELP (RCELP), a vector-sum excited linear estimation (VSELP), a mixed excitation linear estimation (MELP), a regular pulse excitation (RPE), and a multi pulse excitation (MPE), but are not limited thereto. Related codec algorithms may include a multi-band excitation (MBE) and/or a prototype waveform interpolation (PWI).

The high-band signal generator 130 may estimate extension parameters necessary for generating a high-band signal by using a reconstructed narrowband signal provided by the narrowband decoder 110 and may generate a high-band signal based on the estimated extension parameters. Here, examples of the extension parameters may include a spectrum parameter and an excitation signal. Examples of the spectrum parameter may include at least one of an envelope signal, an energy level, or a gain, whereas the excitation signal may be a residual signal or a residual error signal. The configuration and the operation of the high-band signal generator 130 will be described later.

The synthesizer 150 may generate a wideband signal by synthesizing the reconstructed narrowband signal provided by the narrowband decoder 110 with a high-band signal provided by the high-band signal generator 130.

Figure 2:
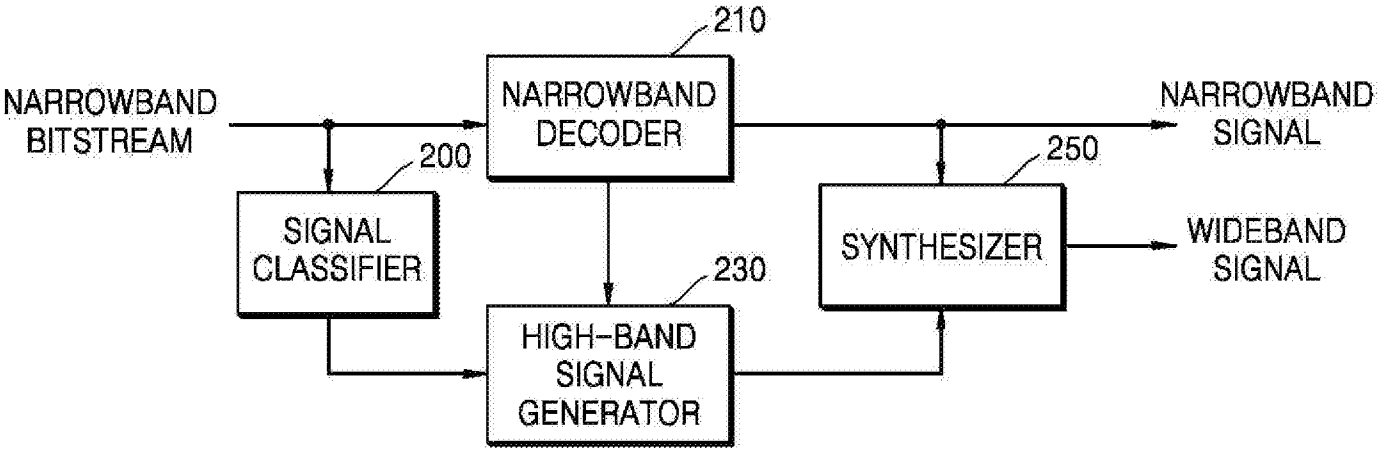
FIG. 2 shows a block diagram of a wideband signal generating apparatus according to another exemplary embodiment.

FIG. 2 is a block diagram showing the configuration of a wideband signal generating apparatus according to another exemplary embodiment.

The wideband signal generating apparatus shown in FIG. 2 may include a signal classifier 200, a narrowband decoder 210, a high-band signal generator 230, and a synthesizer 250. Same as those shown in FIG. 1, the above-stated components may be included in a single device or may be included in different devices according to design specifications. Unlike the wideband signal generating apparatus of FIG. 1, the signal classifier 200 may be additionally arranged to selectively perform bandwidth extension based on signal characteristics. Detailed descriptions of components identical to those described above will be omitted.

Referring to FIG. 2, the signal classifier 200 may analyze a narrowband bitstream or a reconstructed narrowband signal and divide the same into a voiced sound section and the remaining section, e.g., an unvoiced sound section. Here, various techniques known in the art may be used to identify a voiced sound section and an unvoiced sound section. For example, parameters including a gradient, a spectral tilt, and a zero crossing rate may be applied therefor.

According to an embodiment, bandwidth extension may be selectively performed with regard to a voiced sound section and an unvoiced sound section. In other words, bandwidth extension may be performed on a voiced sound section, whereas no bandwidth extension may be performed on an unvoiced sound section. According to an embodiment, with regard to an unvoiced sound section, Os or predetermined noise components may be filled into a high-band. For a voiced sound section, the signal classifier 200 may provide an enable signal for operating the high-band signal generator 230 to the high-band signal generator 230. According to another embodiment, the signal classifier 200 may determine whether to provide a reconstructed narrowband signal from the narrowband decoder 210 to the high-band signal generator 230 with regard to a voiced sound section or an unvoiced sound section.

Regarding the voiced sound section of a narrowband signal, the high-band signal generator 230 may estimate extension parameters for generating a high-band signal by using a reconstructed narrowband signal provided by the narrowband decoder 110 and generate a high-band signal by using the estimated extension parameters.

The synthesizer 250 may generate a wideband signal by synthesizing the reconstructed narrowband signal provided by the narrowband decoder 210 with the high-band signal provided by the high-band signal generator 230.

Figure 3:
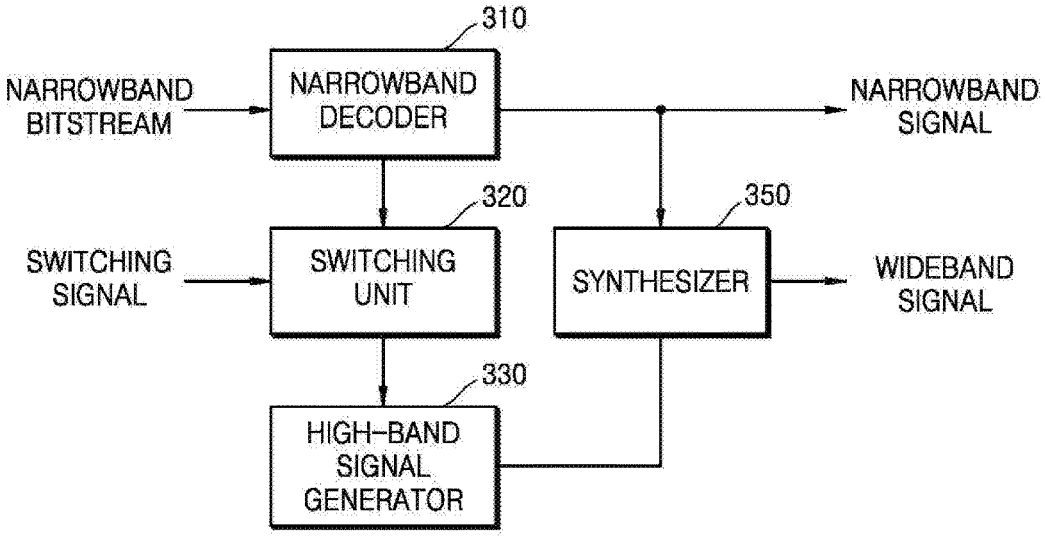
FIG. 3 shows a block diagram of a wideband signal generating apparatus according to another exemplary embodiment.

FIG. 3 is a block diagram showing the configuration of a wideband signal generating apparatus according to another exemplary embodiment.

The wideband signal generating apparatus shown in FIG. 3 may include a narrowband decoder 310, a switching unit 320, a high-band signal generator 330, and a synthesizer 350. Same as those shown in FIG. 1, the above-stated components may be included in a single device or may be included in different devices according to design specifications. Unlike the wideband signal generating apparatus of FIG. 1 or FIG. 2, the switching unit 320 may be additionally disposed to determine whether to perform bandwidth extension based on a switching signal generated from a user input. Detailed descriptions of components identical to those described above will be omitted.

Referring to FIG. 3, the switching unit 320 may provide a reconstructed narrowband signal from the narrowband decoder 310 to the high-band signal generator 330 based on a switching signal. Here, the switching signal may be generated as a user manipulates a switch (not shown) or a button (not shown) based on the user's determination to listen to a narrowband signal or a wideband signal.

The high-band signal generator 330 may estimate extension parameters for generating a high-band signal by using a reconstructed narrowband signal from the narrowband decoder 310 and the switching unit 320 and generate a high-band signal by using the estimated extension parameters.

The synthesizer 350 may generate a wideband signal by synthesizing the reconstructed narrowband signal provided by the narrowband decoder 310 with the high-band signal provided by the high-band signal generator 330.

According to another embodiment, when the wideband signal generating apparatus is embodied to provide a reconstructed narrowband signal from the narrowband decoder 310 to the high-band signal generator 330, the wideband signal generating apparatus may be designed, such that the high-band signal generator 330 operates when a switching signal is generated based on a user input.

Figure 4:
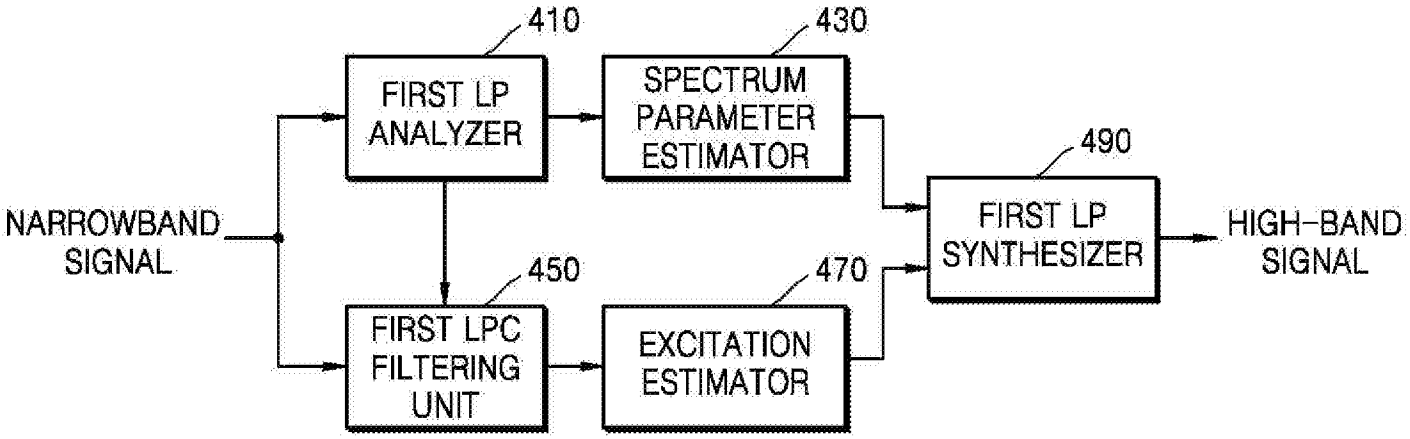
FIG. 4 shows a block diagram of a high-band signal generating module according to an exemplary embodiment.

FIG. 4 is a block diagram showing the configuration of a high-band signal generating module according to an embodiment that may correspond to the high-band signal generator 130, 230, or 330 of FIG. 1, 2 or 3.

The high-band signal generating module shown in FIG. 4 may be based on the analysis-by-synthesis structure and may include a first linear prediction (LP) analyzer 410, a spectrum parameter estimator 430, a first linear prediction coding (LPC) filtering unit 450, an excitation estimator 470, and a first LP synthesizer 490. The above-stated components may be integrated as at least one module and may be embodied as at least one processor. A transfer function of the first LP analyzer 410 and a transfer function of the first LP synthesizer 490 included in the analysis-by-synthesis structure may have an inverse relationship with each other.

Referring to FIG. 4, the first LP analyzer 410 may generate a narrowband LPC coefficient by performing a linear LP analysis on a reconstructed narrowband signal.

The spectrum parameter estimator 430 may estimate a high-band spectrum parameter, e.g., a high-band envelope signal, by using the narrowband LPC coefficient provided by the first LP analyzer 410. In detail, the spectrum parameter estimator 430 may estimate a high-band envelope signal by mapping a narrowband LPC coefficient to a high-band LPC coefficient by using a combination of at least two mapping schemes. Furthermore, the spectrum parameter estimator 430 may estimate a gain from a narrowband LPC coefficient or a narrowband signal provided by the first LP analyzer 410. A gain may be estimated by using various techniques known in the art. According to an embodiment, the spectrum parameter estimator 430 may combine at least two mapping schemes, e.g., a codebook mapping and a linear mapping. Since it is difficult to process (e.g., quantize) a LPC coefficient efficiently, a LPC coefficient may be commonly converted to another format, e.g., a line spectrum pair (LSP) coefficient or a line spectrum frequency (LSF) coefficient. Furthermore, an LPC coefficient may include another format, e.g., a parcor coefficient, a log-area ratio value, an immittance spectrum pair coefficient, or an immittance spectrum frequency coefficient. Alternatively, a cepstral coefficient may be used instead of an LPC coefficient.

The first LPC filtering unit 450 may generate a narrowband excitation signal by filtering a narrowband LPC coefficient provided by the first LP analyzer 410 from the reconstructed narrowband signal.

The excitation estimator 470 may generate a whitened narrowband excitation signal by performing LP analysis and LPC filtering on a narrowband excitation signal provided by the first LPC filtering unit 450 and estimate a high-band excitation signal by using the whitened narrowband excitation signal. In detail, a whitened high-band excitation signal may be generated by shifting the whitened narrowband excitation signal to a corresponding high-band, a narrowband excitation LPC coefficient may be generated by performing LP analysis on the narrowband excitation signal, and the narrowband excitation LPC coefficient may be linearly mapped to a corresponding high-band excitation LPC coefficient, and thus a high-band excitation LPC coefficient may be generated. A high-band excitation signal may be generated by performing LP synthesis on the whitened high-band excitation signal and the high-band excitation LPC coefficient. Although an LPC coefficient is used instead of an LSP coefficient for convenience of explanation, the LSP coefficient may be preferably used for linear mapping.

The first LP synthesizer 490 may generate a high-band signal by performing LP synthesis on a high-band spectrum parameter estimated by the spectrum parameter estimator 430 and a high-band excitation signal estimated by the excitation estimator 470.

Figure 5:
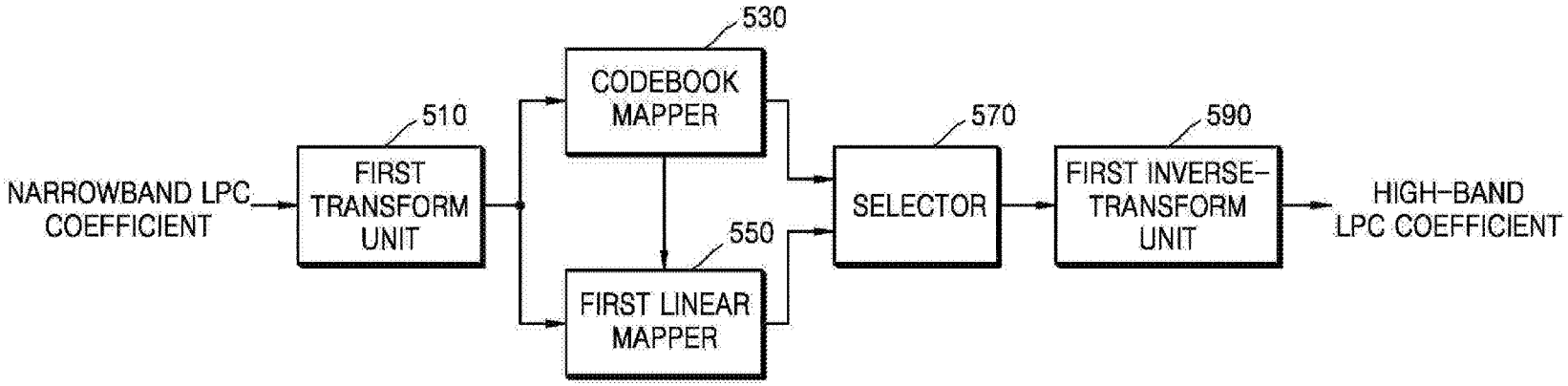
FIG. 5 shows a block diagram of a spectrum parameter estimating module according to an exemplary embodiment.

FIG. 5 is a block diagram showing the configuration of a spectrum parameter estimating module according to an exemplary embodiment that may correspond to the spectrum parameter estimator 430 of FIG. 4.

The spectrum parameter estimating module shown in FIG. 4 may include a first transform unit 510, a codebook mapper 530, a first linear mapper 550, a selector 570, and a first inverse-transform unit 590. Here, the first transform unit 510 and the first inverse-transform unit 590 may be selectively included according to coefficients used for estimating a spectrum parameter.

Referring to FIG. 5, the first transform unit 510 may transform a narrowband LPC coefficient to a narrowband LSP coefficient and provide the narrowband LSP coefficient to the codebook mapper 530 and the first linear mapper 550.

The codebook mapper 530 may generate a first high-band LSP coefficient, which is a first extended spectrum parameter (that is, a first high-band codeword), by mapping a narrowband LSP coefficient to a corresponding high-band LSP coefficient by using a high-band codebook corresponding to a narrowband codebook. Each of the narrowband codebook and the high-band codebook may be designed to include N groups of codewords adjacent to one another. Each group may include the same number of codewords, but is not limited thereto. Here, codewords adjacent to one another may refer to codewords corresponding to frequencies or sizes similar to one another.

Based on a mapping result provided by the codebook mapper 530, the first linear mapper 550 may generate a first high-band LSP coefficient, which is a second extended spectrum parameter (that is, a second high-band codeword), by mapping a narrowband LSP coefficient by using a linear matrix. Here, the linear matrix may be obtained based on a relationship between narrowband training data and high-band training data.

The selector 570 may compare the first high-band LSP coefficient and the second high-band LSP coefficient to the narrowband LSP coefficient and select one of the high-band LSP coefficients exhibiting less spectrum distortion.

The first inverse-transform unit 590 may generate a high-band LPC coefficient by inverse-transforming the LSP coefficient selected by the selector 570. At least one high-band spectrum parameter, such as an envelope signal, an energy level, or a gain, may be estimated from the generated high-band LPC coefficient.

Figure 6:
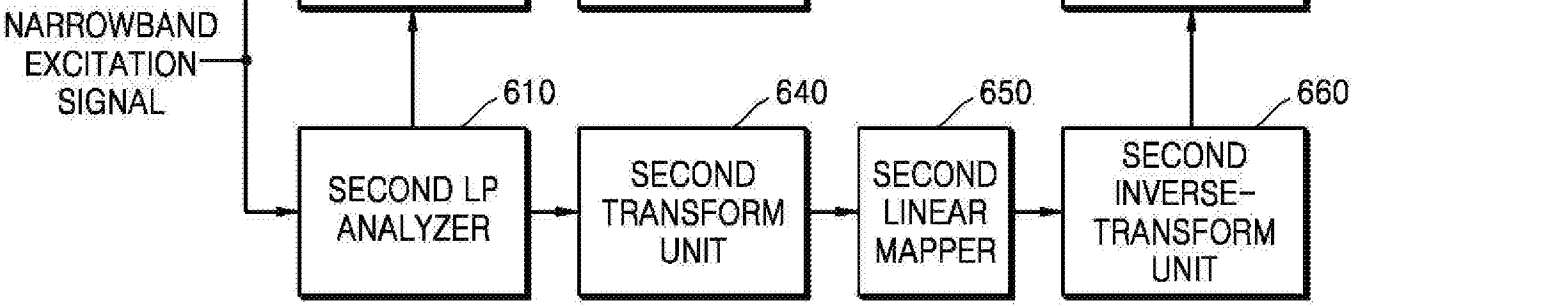
FIG. 6 shows a block diagram of an excitation estimating module according to an exemplary embodiment.

FIG. 6 is a block diagram showing the configuration of an excitation estimating module according to an exemplary embodiment that may correspond to the excitation estimator 470 of FIG. 4.

The excitation estimating module shown in FIG. 6 may include a second LP analyzer 610, a second LPC filtering unit 620, a shifter 630, a second transform unit 640, a second linear mapper 650, a second inverse-transform unit 660, and a second LP synthesizer 670. Here, according to coefficients used for estimating excitation, the second transform unit 640 and the second inverse-transform unit 660 may be selectively included. A transfer function of the second LP analyzer 610 and a transfer function of the second LP synthesizer 670 may have an inverse relationship with each other.

Referring to FIG. 6, the second LP analyzer 610 may generate an excitation LPC coefficient by performing LP analysis on a narrowband excitation signal. Here, the narrowband excitation signal may be obtained by performing LP analysis and LPC filtering on a reconstructed narrowband signal. According to an embodiment, LP analysis with an order of 6 is performed on a narrowband excitation signal, and thus a narrowband excitation LPC coefficient with an order of 6 may be obtained.

The second LPC filtering unit 620 may generate a whitened narrowband excitation signal by filtering a narrowband excitation LPC coefficient provided by the second LP analyzer 610 from a narrowband excitation signal.

The shifter 630 may shift a whitened narrowband excitation signal provided by the second LPC filtering unit 620 to a correspond high-band. In detail, since an excitation signal has a flat spectrum characteristic, a whitened high-band excitation signal may be generated by copying a whitened narrowband excitation signal to a high band in a frequency domain. According to an embodiment, an adaptive spectral shifting for adjusting the frequency of a narrowband excitation signal shifted to the high-band based on pitch information may be applied. When the adaptive spectral shifting is applied, a similar harmonic structure may be maintained between the narrowband and the high-band.

In detail, the lower region and the upper region of a high-band excitation signal in a frequency domain may be obtained by copying the upper region of a whitened narrowband excitation signal. Here, for example, the upper region of the whitened narrowband excitation signal may be a range from 1.9 kHz to 3.8 kHz, whereas the lower region and the upper region of the high-band excitation signal may be from ~3.8 kHz to 5.7 kHz and from ~5.7 kHz to 7.6 kHz. ~3.8 kHz and ~5.7 kHz indicate multiples of a fundamental frequency that is close to 3.8 kHz and 5.7 kHz and do not exceed 3.8 kHz and 5.7 kHz, respectively. For example, the fundamental frequency may be about 1.9 kHz.

Although a spectral shifting technique is employed in the exemplary embodiment, a whitened high-band excitation signal may be generated from a whitened narrowband excitation signal by using one of techniques including a non-linear function transform, oversampling excitation, and Gaussian modulation.

The second transform unit 640 may transform a narrowband excitation LPC coefficient provided by the second LP analyzer 610 and generate a narrowband excitation LSP coefficient.

The second linear mapper 650 may generate a high-band excitation LSP coefficient by mapping a narrowband excitation LSP coefficient provided by the second transform unit 640 by using a linear matrix. According to an embodiment, a narrowband excitation LSP coefficient transformed from a narrowband excitation LPC coefficient with an order of 6 may be mapped to a high-band LSP coefficient with an order of 10 by using a single linear matrix. The linear matrix may be obtained based on a relationship between narrowband training data and high-band training data.

The second inverse-transform unit 660 may generate a high-band excitation LPC coefficient by inverse-transforming a high-band excitation LSP coefficient provided by the second linear mapper 650.

The second LP synthesizer 670 may generate a high-band excitation signal by performing LPC synthesis on a whitened high-band excitation signal provided by the shifter 630 and a high-band excitation LPC coefficient provided by the second inverse-transform unit 660.

Although the linear mapping is applied in the exemplary embodiment, a high-band excitation LSP coefficient may be generated from a narrowband excitation LSP coefficient by using a non-linear function or one of various other transform techniques.

Figure 7:
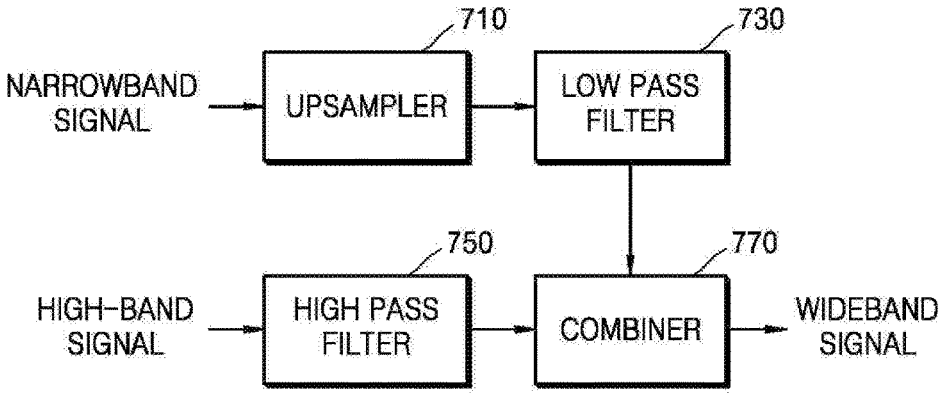
FIG. 7 shows a block diagram of a synthesizing module according to an exemplary embodiment.

FIG. 7 is a block diagram showing the configuration of a synthesizing module according to an exemplary embodiment that may correspond to the synthesizer 150, 250, or 350 shown in FIG. 1, 2 or 3.

The synthesizing module shown in FIG. 7 may include an upsampler 710, a low pass filter 730, a high pass filter 750, and a combiner 770.

Referring to FIG. 7, the upsampler 710 may upsample a reconstructed narrowband signal. The reconstructed narrowband signal may be provided by one of the narrowband decoders 110, 210, and 310 of FIGS. 1, 2, and 3.

The low pass filter 730 may set the maximum frequency of the narrowband as a cutoff frequency and perform low pass filtering on an upsampled narrowband signal provided by the upsampler 710.

The high pass filter 750 may set the minimum frequency of the high-band as a cutoff frequency and perform high pass filtering on a high-band signal generated via blind bandwidth extension. The high-band signal may be provided by one of the high-band signal generators 130, 230, and 330 of FIGS. 1, 2, and 3.

The combiner 770 may generate a wideband signal by combining a narrowband signal provided by the low pass filter 730 with a high-band signal provided by the high pass filter 750.

Figure 8:
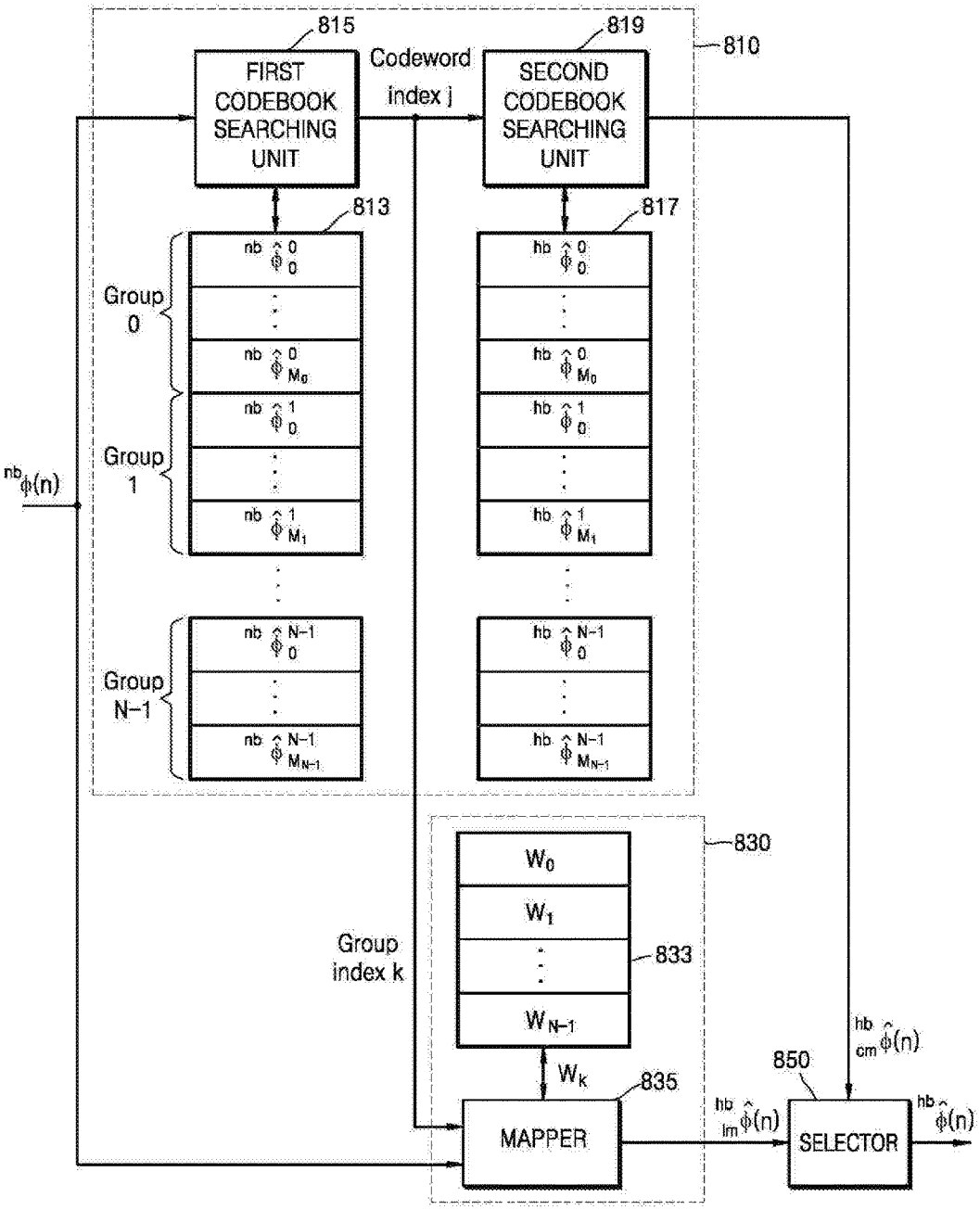
FIG. 8 is a diagram for describing an operation of the spectrum parameter estimating module of FIG. 5.

FIG. 8 is a diagram for describing an operation of the spectrum parameter estimating module shown in FIG. 5.

A codebook mapper 810 shown in FIG. 8 may include a first storage unit 810, a first codebook searching unit 815, a second storage unit 817, and a second codebook searching unit 819. A first linear mapper 830 may include a third storage unit 833 and a mapper 835.

Referring to FIG. 8, in the codebook mapper 810, the first storage unit 813 may store a narrowband codebook, whereas the second storage unit 817 may store a high-band codebook. The narrowband codebook and the high-band codebook may be generated via a training operation based on a Linda, Buzo, and Gray (LBG) algorithm. According to an embodiment, a narrowband to high-band mapping may be performed by using a dual-structured narrowband codebook and high-band codebook. The narrowband codebook may include narrowband codewords and the high-band codebook may include corresponding high-band codewords, where codewords may include representative LSP coefficients in an arbitrary form. The dual-structured narrowband codebook and high-band codebook will be described below in detail.

First, training data sampled at a desired sampling rate may be collected with respect to a wide range of wideband content including frequency components corresponding to the narrowband and frequency components corresponding to the high-band. Here, in order to match the bandwidth of the training data to that of an actual signal to be processed, the training data may be downsampled. A narrowband codebook may be generated by applying the LBG algorithm to narrowband components of the training data. While the LBG algorithm is being applied to narrowband training data, a high-band codebook may also be generated by applying the LBG algorithm to high-band training data. Accordingly, a dual-structured codebook may include a set of representative narrowband codewords and a set of representative high-band codewords correspond thereto. The dual-structured codebook may be generated based on a correlation between a low-band spectrum envelope and a high-band spectrum envelope for a particular speaker or a particular speaker class. Meanwhile, in each codebook, codewords may be grouped with adjacent codewords, where optimal groups may be obtained experimentally or based on a simulation with respect to training data.

The first codebook searching unit 815 may search for a narrowband codebook for a narrowband LSP coefficient and may output a narrowband codeword index and a group index corresponding to the optimal codeword from the narrowband codebook. In other words, when a narrowband codeword index corresponding to the optimal codeword is found, a group index may be automatically determined. The narrowband LSP coefficient may be provided by the first transform unit 510 of FIG. 5.

The second codebook searching unit 819 may search for a high-band codebook by using a narrowband codeword index provided by the first codebook searching unit 815 and obtain a first high-band codeword at a location corresponding to the narrowband codeword index from the high-band codebook. In other words, since locations of codewords of a narrowband codebook are respectively mapped to locations of codewords of a high-band codebook via a training operation, a same codeword index may be applied.

Meanwhile, in the first linear mapper 830, the third storage unit 833 may store N linear matrices corresponding to N groups constituting a narrowband codebook and a high-band codebook respectively stored in the first and/or second storage units 813 and/or 817. Generation of N linear matrices will be described below in detail in conjunction with codebooks used for codebook mapping.

First, based on a nearest neighbor searching with respect to the overall training data, the set of the dual-structured codebook may be partitioned into N cluster sets, that is, N groups. Next, the overall training data may be passed through the N cluster sets to generate per-cluster training data, i.e. per-group training data. Then, N linear matrices may be constructed by applying an optimal matrix solution on N sets of per-group training data. Meanwhile, codewords of the narrowband codebook and codewords of the high-band codebook may be rearranged, such that entries in the cluster i correspond to entries of the group i of each of the narrowband codebook and the high-band codebook. Here, the optimal matrix solution may employ a mapping relationship between narrowband training data and high-band training data.

The mapper 835 may read out a linear matrix corresponding to a group index provided by the first codebook searching unit 815 from the third storage unit 833 and generate a second high-band codeword by multiplying a narrowband LSP coefficient by the read-out linear matrix. A reordering operation may be performed on the generated second high-band codeword in order to sort a sequence of or an interval between LSP coefficients.

The selector 850 may calculate a spectral distortion based on a narrowband signal with respect to a first high-band codeword provided by the codebook mapper 810 and a second high-band codeword provided by the first linear mapper 830 and select one of the high-band codewords corresponding to a smaller spectral distortion value, as shown in Equation 1 below.

$$ {}^{hb}\hat{\underline{f}}(n) = \arg \min_{{}^{hb}\hat{\underline{f}}(n) \in \{{}^{hb}_{cm}\hat{\underline{f}}(n), {}^{hb}_{lm}\hat{\underline{f}}(n)\}} d\left({}^{nb}\underline{f}(n), {}^{hb}\hat{\underline{f}}(n)\right) \quad \text{[Equation 1]} $$

Here, ${}^{hb}\hat{\underline{f}}(n)$ denotes a high-band codeword output by the selector 850, that is, a high-band LSP coefficient. ${}^{hb}\hat{\underline{f}}(n)$ denotes a narrowband LSP coefficient, and ${}^{hb}_{cm}\hat{\underline{f}}(n)$ and ${}^{hb}_{lm}\hat{\underline{f}}(n)$ denote first and second high-band codewords output by the codebook mapper 810 and the first linear mapper 830, respectively. Furthermore, $d({}^{nb}\underline{f}(n), {}^{nb}\hat{\underline{f}}(n))$ may expressed as Equation 2 below.

$$ d\left({}^{nb}\underline{f}(n), {}^{hb}\hat{\underline{f}}(n)\right) = \sum_{i=1}^{p} \left[{}^{nb}f_i(n) - {}^{hb}\hat{f}_i(n)\right]^2 \quad \text{[Equation 2]} $$

Here, p denotes an order of a narrowband LSP coefficient.

According to Equations 1 and 2, spectral distortions between p parameters of a narrowband LSP coefficient and p parameters of a first or second high-band LSP coefficient are calculated, where a high-band LSP coefficient corresponding to a smaller spectral distortion value may be selected.

Figure 9:
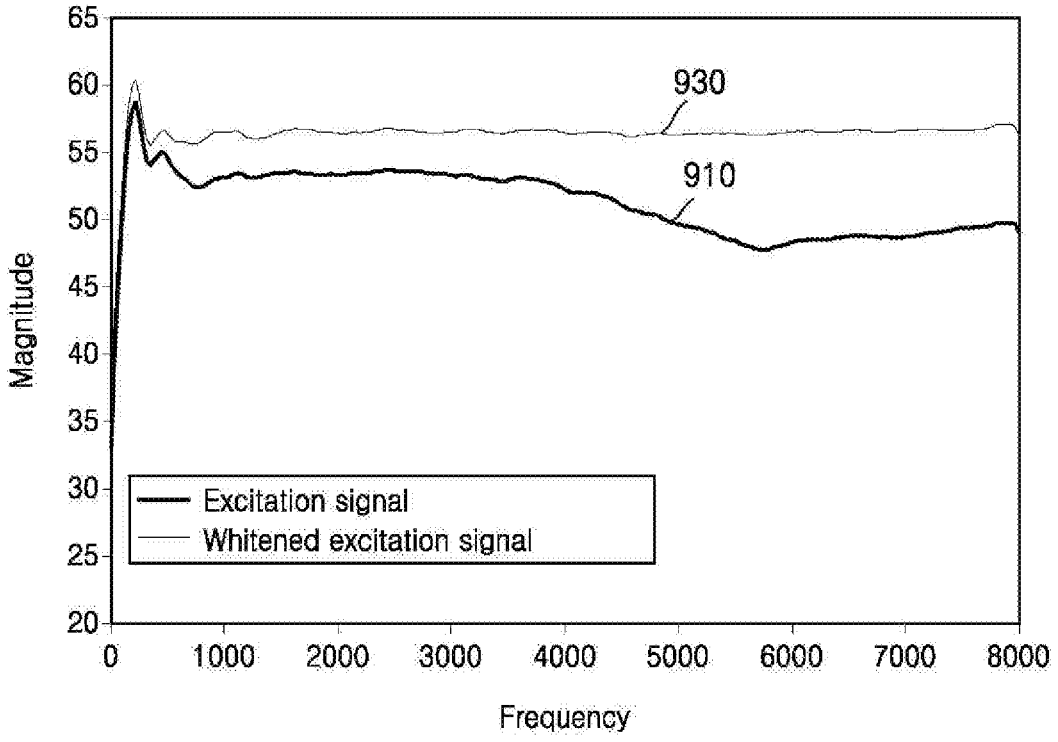
FIG. 9 shows a waveform diagram comparing an excitation signal with a whitened excitation signal.

FIG. 9 is a waveform diagram showing a comparison between an excitation signal and a whitened excitation signal, where the reference numeral 910 denotes an average spectrum of the excitation signal, and the reference numeral 930 denotes an average spectrum of the whitened excitation signal.

Generally, the spectrum 910 of a narrowband excitation signal provided by the first LPC filtering unit 450 of FIG. 4, which functions as a whitening filter, may not be flat. Since a magnitude of a high-band signal is smaller than that of a low-band signal, when a high-band excitation signal is generated by copying a narrowband excitation signal to the high-band by using a spectrum shifting technique, the high-band excitation signal becomes over-estimated, and thus a synthesized high-band signal may be amplified.

In order to prevent amplification of a synthesized high-band signal, when the second LPC filtering unit 620 of FIG. 6 may perform a whitening operation on a narrowband excitation signal provided by the first LPC filtering unit 450 again, a narrowband excitation signal 930 having a relatively flat spectrum may be generated. When the whitened narrowband excitation signal 930 is copied to the high-band, a synthesized high-band signal may not be amplified.

Figure 10A:
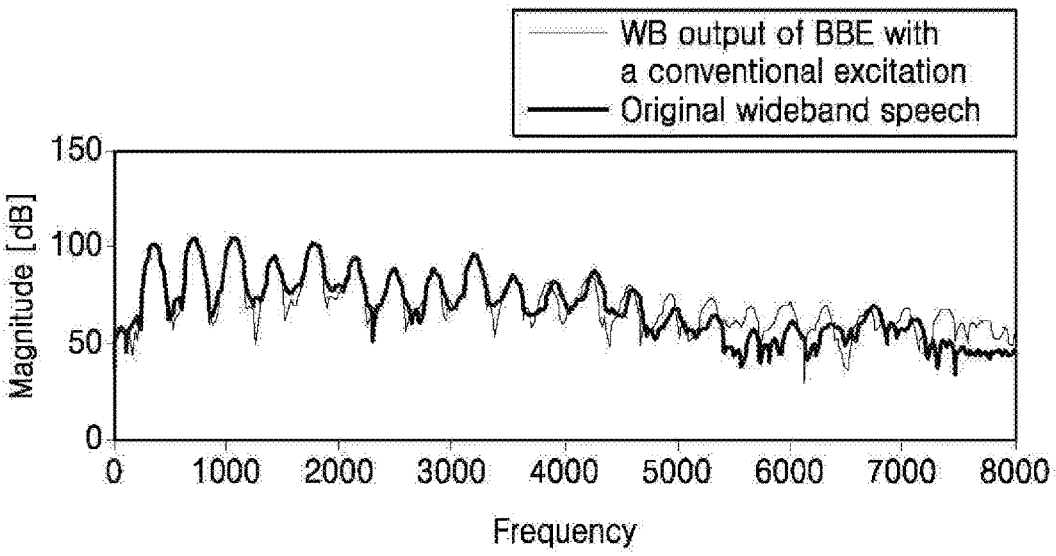
FIGS. 10A and 10B are waveform diagrams showing a result of performing blind bandwidth extension by using a conventional excitation signal and a result of performing blind bandwidth extension by using a whitened excitation signal, respectively.
Figure 10B:
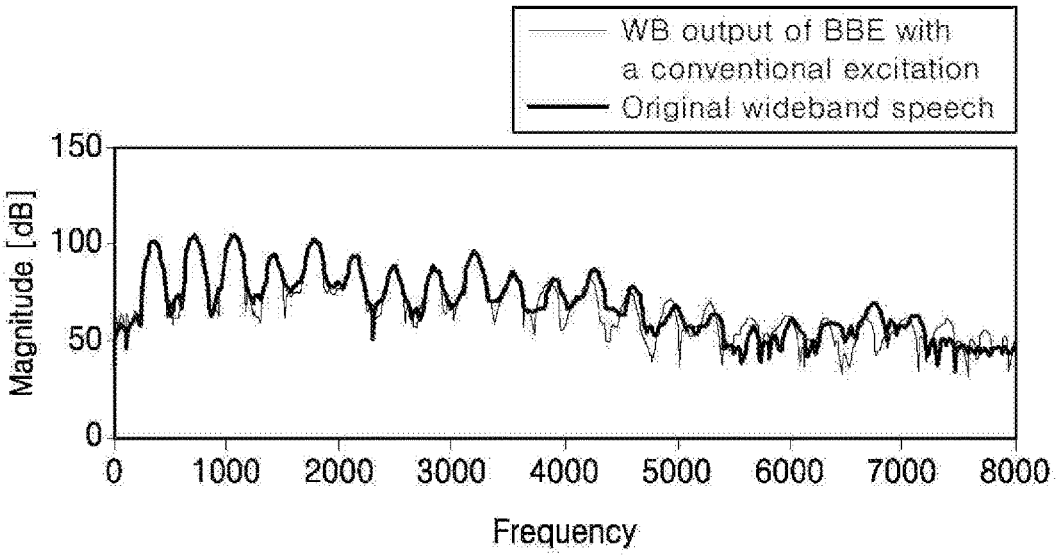

FIGS. 10A and 10B are waveform diagrams showing a result of performing blind bandwidth extension by using a conventional excitation signal and a result of performing blind bandwidth extension by using a whitened excitation signal, respectively.

Referring to FIG. 10A, the magnitude of a synthesized speech signal obtained by performing blind bandwidth extension by using a conventional excitation signal is larger than that of an original speech signal. In other words, the synthesized speech signal is amplified based on an over-estimated high-band excitation signal. Meanwhile, referring to FIG. 10B, the magnitude of a synthesized speech signal obtained by performing blind bandwidth extension by using a whitened excitation signal is equal to or smaller than that of an original speech signal.

In the perceptual aspect, when a whitened excitation signal is used for blind bandwidth extension, less artifacts may be produced as compared to a case of performing blind bandwidth extension by using a conventional excitation signal.

Meanwhile, referring to FIGS. 10A and 10B as a result of applying an adaptive spectrum shifting technique, a generated high-band speech signal has a good pitch coherence with a low-band speech signal.

Figure 11:
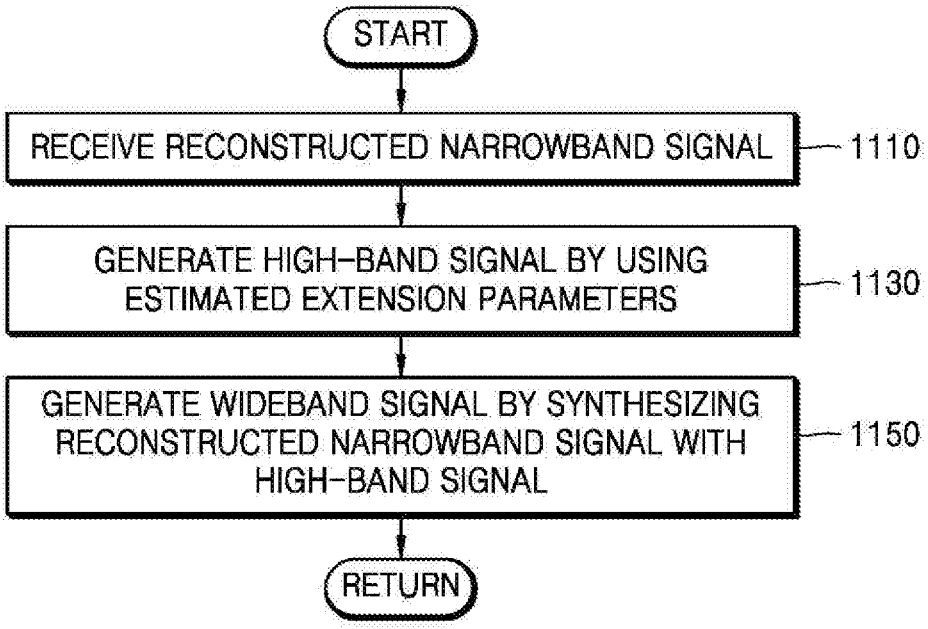
FIG. 11 is a flowchart explaining an operation of a method of generating a wideband signal according to an exemplary embodiment.

FIG. 11 is a flowchart explaining an operation of a method of generating a wideband signal according to an exemplary embodiment, where the method may be performed by at least one processor. Preferably, the method may be performed by the high-band generator 130, 230 or 330 and the synthesizer 150, 250 or 350 of the wideband signal generating apparatus of FIG. 1, 2 or 3.

Referring to FIG. 11, in operation 1110, a reconstructed narrowband signal obtained as a result of decoding a narrowband bitstream may be received.

In operation 1130, extension parameters for generating a high-band signal may be estimated by using the reconstructed narrowband signal, and a high-band signal may be generated by using the estimated extension parameters.

In operation 1150, a wideband signal may be generated by synthesizing the reconstructed narrowband signal with the high-band signal.

According to an embodiment, the method may further include an operation for determining whether an enable signal or a switching signal is generated based on a user input for determining whether to perform bandwidth extension, before the operation 1110. Here, the method may be embodied, such that operations 1110 through 1150 are performed when an enable signal or a switching signal is generated.

According to another embodiment, the method may further include an operation for determining whether to perform bandwidth extension based on characteristics of a narrowband signal, before the operation 1110. Here, the operations 1110 through 1150 may be performed on a voiced sound section of which sound quality may be enhanced via bandwidth extension. The high-band region of the remaining section, e.g., an unvoiced sound section, may be filled with Os or pre-set noise components.

Meanwhile, if the frequency range of the narrowband is from 0.3 kHz to 3.4 kHz and the frequency range of the wideband is from 0.05 kHz to 7 kHz, bandwidth extension based on the generation of a high-band signal as described above may be performed on the range from 3.4 kHz to 7 kHz, whereas bandwidth extension may be performed based on sinusoidals on the range from 0.05 kHz to 0.3 kHz.

Figure 12:
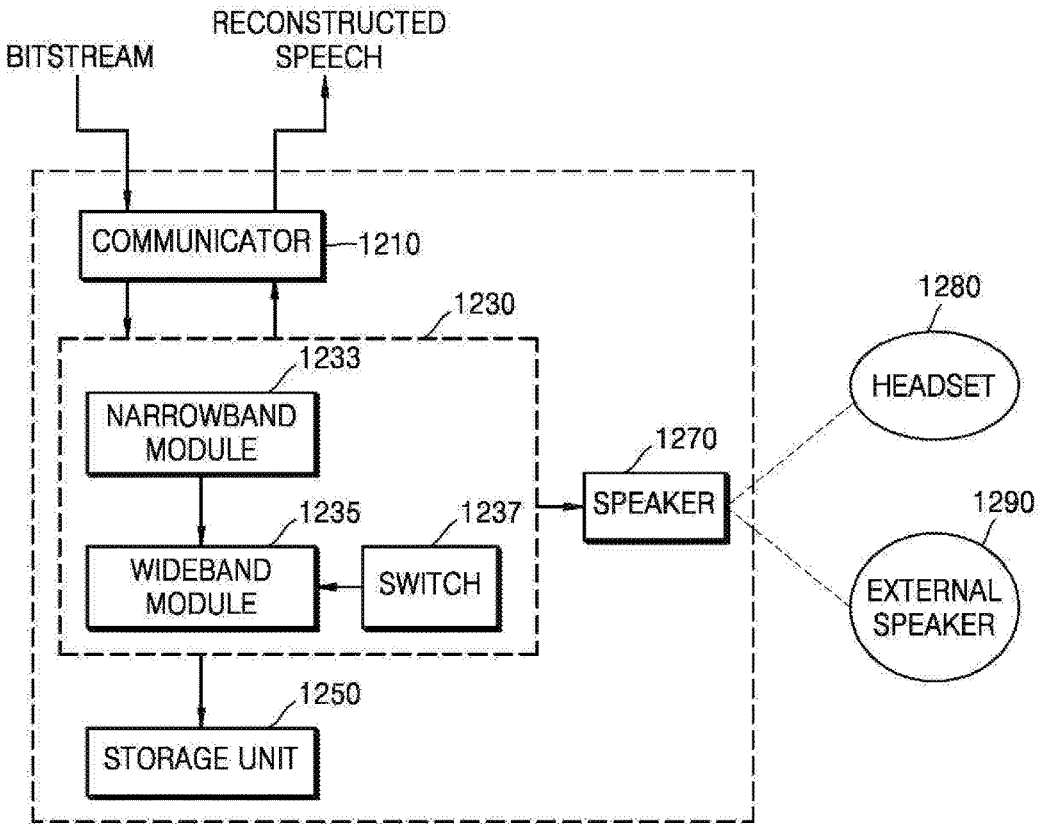
FIG. 12 shows a block diagram of a multimedia device including a decoding module according to an exemplary embodiment.

FIG. 12 is a block diagram showing the configuration of a multimedia device including a decoding module according to an exemplary embodiment.

A multimedia device 1200 shown in FIG. 12 may include a communicator 1210 and a decoding module 1230. Based on the purpose of a reconstructed narrowband signal obtained as a result of decoding of a narrowband bitstream, the multimedia device 1200 may further include a storage unit 1250 that stores a reconstructed narrowband signal. The multimedia device 1200 may further include a speaker 1270. In other words, the storage unit 1250 and the speaker 1270 may be selectively included. The decoding module 1230 may include a narrowband module 1233 and a wideband module 1235. The narrowband module 1233 may operate according to an arbitrary narrowband decoding algorithm that may be embodied based on one of various codec algorithms known in the art. The wideband module 1235 may operate based on a bandwidth extension algorithm and may be embodied according to one of the embodiments as shown in FIGS. 1 through 8. The decoding module 1230 may selectively include a switch 1237. Meanwhile, the multimedia device 1200 shown in FIG. 12 may further include an arbitrary encoding module (not shown), e.g., an encoding module that performs a common encoding operation. Here, the decoding module 1230 may be integrated with other components (not shown) included in the multimedia device 1200 and may be embodied as at least one processor (not shown). The multimedia device 1200 may be connected to a headset 1280 or an external speaker 1290. Here, the wideband module 1235 may be included in the headset 1280 instead of the decoding module 1230, where the switch 1237 may be selectively included. In the same regard, the wideband module 1235 may be included in the external speaker 1290 instead of the decoding module 1230, where the switch 1237 may be selectively included.

Referring to FIG. 12, the communicator 1210 may receive at least one of an encoded narrowband bitstream and a narrowband signal provided from the outside or transmit a reconstructed narrowband signal obtained as a result of a decoding operation performed by the decoding module 1230 and a narrowband bitstream obtained as a result of an encoding operation. The communicator 1210 may be configured to be able to exchange data with an external multimedia device or an external server via a wireless network, such as a wireless internet, a wireless intranet, a wireless telephone network, a wireless LAN, a Wi-Fi network, a Wi-Fi direct (WFD) network, a third generation (3G) network, a fourth generation (4G) network, a Bluetooth network, an infrared data association (IrDA) network, a radio frequency identification (RFID) network, a ultra wideband (UWB) network, a Zigbee network, and a near field communication (NFC) network, or a wired network, such as a wired telephone network or a wired internet.

The decoding module 1230 may include a common narrowband decoding algorithm and a common bandwidth extension algorithm, where the bandwidth extension algorithm may be performed as the default algorithm or may be selectively perforjmed based on a user input received via the switch 1337 or characteristics of a narrowband signal. The bandwidth extension algorithm included in the decoding module 1230 may be based on the operations of the wideband signal generating apparatus of FIG. 1, 2 or 3. The decoding module 1230 may generate a narrowband signal, a wideband signal, or an ultra-wideband signal.

The storage unit 1250 may store a narrowband signal or a wideband signal generated by the decoding module 1230. Meanwhile, the storage unit 1250 may store various programs for operating the multimedia device 1200.

The speaker 1270 may output a narrowband signal or a wideband signal generated by the decoding module 1230 to outside.

Meanwhile, the speaker 1270 may be connected to an outside headset 1280 or an external speaker 1290 in a wired or wireless manner, where the bandwidth extension algorithm may be embodied in the headset 1280 or the external speaker 1290 instead of the decoding module 1230. In this case, the headset 1280 or the external speaker 1290 may be configured to execute the bandwidth extension algorithm when the bandwidth extension algorithm is executed as the default algorithm or it is determined to perform bandwidth extension based on a user input received via the switch 1237 included in the headset 1280 or the external speaker 1290.

Figure 13:
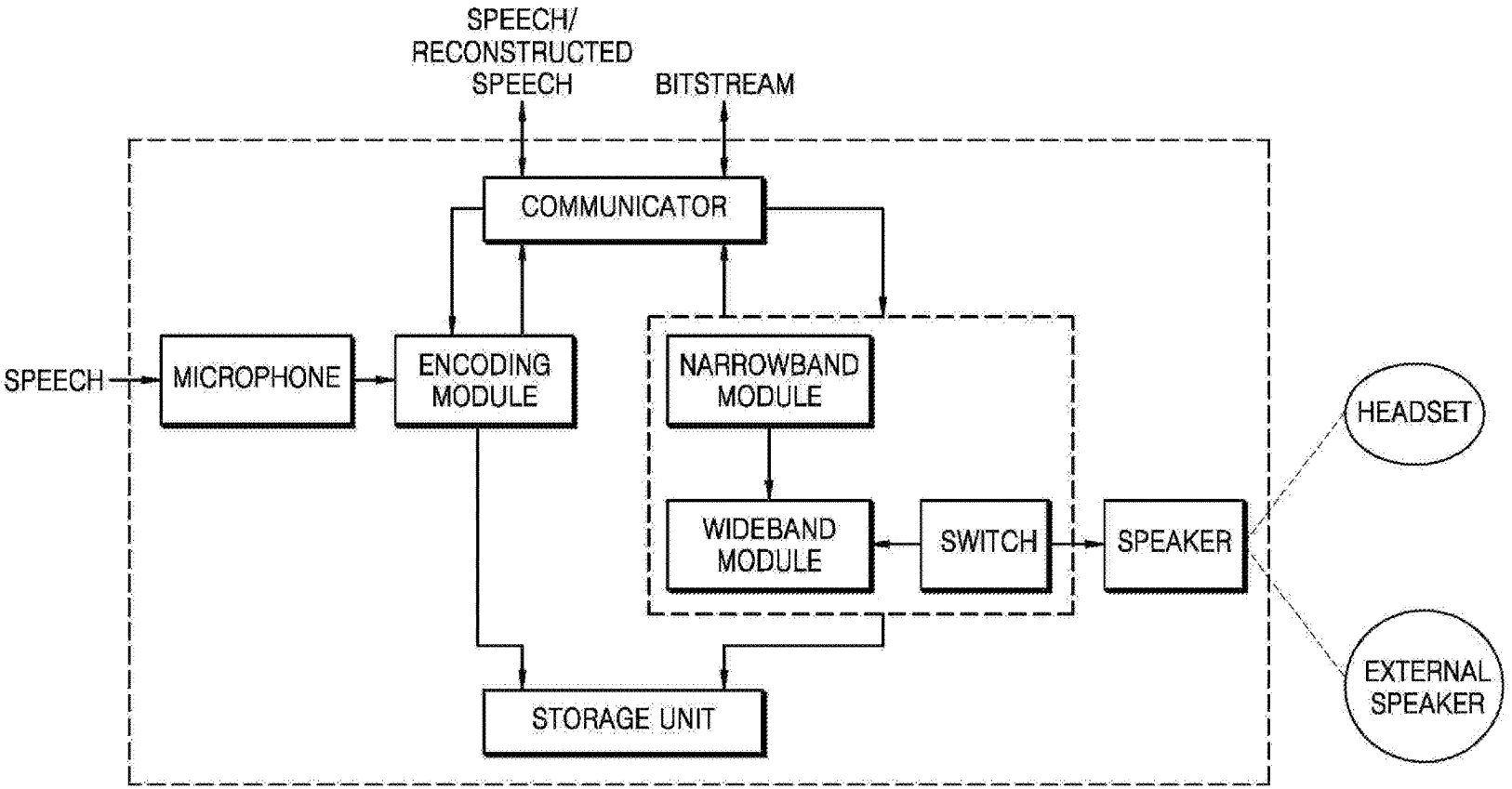
FIG. 13 shows a block diagram of a multimedia device including an encoding module and a decoding module according to an exemplary embodiment.

FIG. 13 is a block diagram showing the configuration of a multimedia device including an encoding module and a decoding module according to an exemplary embodiment.

A multimedia device 1300 shown in FIG. 13 may include a communicator 1310, an encoding module 1340, and a decoding module 1330. Based on the purpose of a narrowband bitstream obtained as a result of encoding or a reconstructed narrowband signal obtained as a result of decoding, the multimedia device 1300 may further include an encoding module 1340 that stores a narrowband bitstream or a reconstructed narrowband signal. The multimedia device 1300 may further include a microphone 1350 or a speaker 1360. The decoding module 1330 may include a narrowband module 1333 and a wideband module 1335. The narrowband module 1333 may operate according to an arbitrary narrowband decoding algorithm that may be embodied based on one of various codec algorithms known in the art. The wideband module 1335 may operate based on a bandwidth extending algorithm and may be embodied according to one of the embodiments as shown in FIGS. 1 through 8. The decoding module 1330 may selectively include a switch 1337. The encoding module 1340 may perform a common encoding operation and may be embodied based on one of various codec algorithms known in the art. The multimedia device 1300 may be connected to a headset 1380 or an external speaker 1390. Here, the wideband module 1335 may be included in the headset 1380 instead of the decoding module 1330, where the switch 1337 may be selectively included. In the same regard, the wideband module 1335 may be included in the external speaker 1390 instead of the decoding module 1330, where the switch 1337 may be selectively included. Here, the encoding module 1340 and the decoding module 1330 may be integrated with other components (not shown) included in the multimedia device 1300 and may be embodied as at least one processor (not shown). Since operations of the other components of the multimedia device 1300 are similar to those of the components of the multimedia device 1200 of FIG. 12, detailed description thereof will be omitted.

The multimedia devices 1200 and 1300 shown in FIGS. 12 and 13 may include a a voice communication dedicated terminal, such as a telephone or a mobile phone, a broadcasting or music dedicated device, such as a TV or an MP3 player, or a hybrid terminal device of a voice communication dedicated terminal and a broadcasting or music dedicated device but are not limited thereto. In addition, each of the multimedia devices 1100, 1200, and 1300 may be used as a client, a server, or a transducer displaced between a client and a server.

When the multimedia device 1200 or 1300 is, for example, a mobile phone, although not shown, the multimedia device 1500, 1600, or 1700 may further include a user input unit, such as a keypad, a display unit for displaying information processed by a user interface or the mobile phone, and a processor for controlling the functions of the mobile phone. In addition, the mobile phone may further include a camera unit having an image pickup function and at least one component for performing a function required for the mobile phone.

When the multimedia device 1200 or 1300 is, for example, a TV, although not shown, the multimedia device 1200 or 1300 may further include a user input unit, such as a keypad, a display unit for displaying received broadcasting information, and a processor for controlling all functions of the TV. In addition, the TV may further include at least one component for performing a function of the TV.

The above-described embodiments of the present invention may be implemented as programmable instructions executable by a variety of computer components and stored in a computer readable recording medium. The computer readable recording medium may include program instructions, a data file, a data structure, or any combination thereof. The program instructions stored in the computer readable recording medium may be designed and configured specifically for the present invention or can be publicly known and available to those skilled in the field of software. Examples of the computer readable recording medium include a hardware device specially configured to store and perform program instructions, for example, a magnetic medium, such as a hard disk, a floppy disk, and a magnetic tape, an optical recording medium, such as a CD-ROM, a DVD, and the like, a magneto-optical medium, such as a floptical disc, a ROM, a RAM, a flash memory, and the like. Examples of the program instructions include machine codes made by, for example, a compiler, as well as high-level language codes executable by a computer using an interpreter. (The above exemplary hardware device can be configured to operate as one or more software modules in order to perform the operation in an exemplary embodiment, and vice versa.)

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

The invention claimed is:

1. A method of generating a wideband signal in a decoding device, the method comprising:

estimating a high-band spectrum parameter from a reconstructed narrowband signal, based on a combination of at least two mapping schemes;

estimating a high-band excitation signal from the reconstructed narrowband signal;

generating a high-band signal based on the estimated high-band spectrum parameter and the estimated high-band excitation signal; and generating a wideband signal for reproduction, by synthesizing the reconstructed narrowband signal with the generated high-band signal, wherein the at least two mapping schemes comprise a codebook mapping scheme and a linear mapping scheme, and wherein the estimating of the high-band spectrum parameter comprises mapping a narrowband LPC coefficient obtained from the reconstructed narrowband signal to a corresponding high-band LPC coefficient, by using the combination of the at least two mapping schemes.

2. The method of claim 1, wherein, the estimating of the high-band excitation signal comprises whitening the reconstructed narrowband signal and estimating the high-band excitation signal based on the whitened narrowband signal.

3. The method of claim 1, wherein a narrowband codebook and a corresponding high-band codebook which are dual-structured are used for the codebook mapping scheme.

4. The method of claim 1, wherein the estimating of the high-band spectrum parameter comprises:

obtaining a first extended spectrum parameter from the reconstructed narrowband signal, based on codebook mapping using a narrowband codebook and a corresponding high-band codebook;

obtaining a second extended spectrum parameter by linearly mapping the reconstructed narrowband signal, based on information provided as a result of the codebook mapping; and selecting either the first extended spectrum parameter or the second extended spectrum parameter as the high-band spectrum parameter.

5. The method of claim 4, wherein, in the selecting of the high-band spectrum parameter, the first extended spectrum parameter and the second extended spectrum parameter are compared to the reconstructed narrowband signal and one with less distortion is selected.

6. A non-transitory computer readable recording medium having recorded thereon a computer program for implementing the method of any claim 1.

7. A wideband signal generating apparatus in a decoding device, the apparatus comprising:

a high-band signal generator, implemented by at least one processor, which estimates a high-band envelope signal from a reconstructed narrowband signal, based on a combination of at least two mapping schemes, estimates a high-band excitation signal based on a signal obtained by whitening the reconstructed narrowband signal, and generates a high-band signal based on the estimated high-band envelope signal and the estimated high-band excitation signal; and a synthesizer, implemented by the at least one processor, which generates a wideband signal for reproduction, by synthesizing the reconstructed narrowband signal with the generated high-band signal, wherein the at least two mapping schemes comprise a codebook mapping scheme and a linear mapping scheme, and wherein the high-band signal generator comprises:

a spectrum parameter estimator, which generates a corresponding high-band LPC coefficient from a narrowband LPC coefficient obtained as a result of performing a LP analysis on the reconstructed narrowband signal, so as to estimate the high-band envelope signal; and an excitation estimator, which generates the high-band excitation signal from the reconstructed narrowband signal based on a whitened excitation signal obtained by filtering the narrowband LPC coefficient.

8. The wideband signal generating apparatus of claim 7, wherein the high-band signal generator estimates the high-band envelope signal based on a combination of the linear mapping scheme and the codebook mapping scheme using a narrowband codebook and a corresponding high-band codebook which are dual-structured.

9. A multimedia device comprising:

a narrowband decoder, implemented by at least one processor, which generates a reconstructed narrowband signal by decoding a narrowband bitstream; and a wideband signal generating apparatus in a decoding device, the apparatus comprising:

a high-band signal generator, implemented by the at least one processor, which estimates a high-band envelope signal from a reconstructed narrowband signal, based on a combination of at least two mapping schemes, estimates a high-band excitation signal based on a signal obtained by whitening the reconstructed narrowband signal, and generates a high-band signal based on the estimated high-band envelope signal and the estimated high-band excitation signal; and a synthesizer, implemented by the at least one processor, which generates a wideband signal for reproduction, by synthesizing the reconstructed narrowband signal with generated the high-band signal, wherein the at least two mapping schemes comprise a codebook mapping scheme and a linear mapping scheme, and wherein the high-band signal generator comprises:

a spectrum parameter estimator, which generates a corresponding high-band LPC coefficient from a narrowband LPC coefficient obtained as a result of performing a LP analysis on the reconstructed narrowband signal, so as to estimate the high-band envelope signal; and an excitation estimator, which generates the high-band excitation signal from the reconstructed narrowband signal based on a whitened excitation signal obtained by filtering the narrowband LPC coefficient.

10. The multimedia device of claim 9, wherein the high-band signal generator estimates the high-band envelope signal based on a combination of the linear mapping scheme and the codebook mapping scheme using a narrowband codebook and a corresponding high-band codebook which are dual-structured.

11. A headset with a wideband signal generating apparatus in a decoding device, the apparatus comprising:

a high-band signal generator, implemented by at least one processor, which estimates a high-band envelope signal from a reconstructed narrowband signal, based on a combination of at least two mapping schemes, estimates a high-band excitation signal based on a signal obtained by whitening the reconstructed narrowband signal, and generates a high-band signal based on the estimated high-band envelope signal and the estimated high-band excitation signal; and a synthesizer implemented by the at least one processor, which generates a wideband signal for reproduction, by synthesizing the reconstructed narrowband signal with the generated high-band signal, wherein the at least two mapping schemes comprise a codebook mapping scheme and a linear mapping scheme, and wherein the estimating of the high-band spectrum parameter comprises mapping a narrowband LPC coefficient obtained from the reconstructed narrowband signal to a corresponding high-band LPC coefficient, by using the combination of the at least two mapping schemes.

12. The headset of claim 11 further comprising a switch for determining whether to operate the apparatus based on a user input.

13. The headset of claim 11, wherein the high-band signal generator estimates the high-band envelope signal based on a combination of the linear mapping scheme and the codebook mapping scheme using a narrowband codebook and a corresponding high-band codebook which are dual-structured.

14. A speaker with a wideband signal generating apparatus in a decoding device, the apparatus comprising:

a high-band signal generator implemented by at least one processor, which estimates a high-band envelope signal from a reconstructed narrowband signal, based on a combination of at least two mapping schemes, estimates a high-band excitation signal based on a signal obtained by whitening the reconstructed narrowband signal, and generates a high-band signal based on the estimated high-band envelope signal and the estimated high-band excitation signal; and a synthesizer, implemented by the at least one processor, which generates a wideband signal for reproduction, by synthesizing the reconstructed narrowband signal with the generated high-band signal, wherein the at least two mapping schemes comprise a codebook mapping scheme and a linear mapping scheme, and wherein the estimating of the high-band spectrum parameter comprises mapping a narrowband LPC coefficient obtained from the reconstructed narrowband signal to a corresponding high-band LPC coefficient, by using the combination of the at least two mapping schemes.

15. The speaker of claim 14 further comprising a switch for determining whether to operate the apparatus based on a user input.

16. The speaker of claim 14, wherein the high-band signal generator estimates the high-band envelope signal based on a combination of the linear mapping scheme and the codebook mapping scheme using a narrowband codebook and a corresponding high-band codebook which are dual-structured.

* * * * *